US006170187B1

(12) United States Patent
Herrmann et al.

(10) Patent No.: US 6,170,187 B1
(45) Date of Patent: Jan. 9, 2001

(54) WEAPON TUBE

(75) Inventors: Ralf-Joachim Herrmann, Senzig; Udo Sabranski, Lachendorf; Henning von Seidlitz, Neuss, all of (DE)

(73) Assignee: Rheinmetall W & M GmbH, Unterluss (DE)

( * ) Notice: Under 35 U.S.C. 154(b), the term of this patent shall be extended for 0 days.

(21) Appl. No.: 09/109,177

(22) Filed: Jul. 2, 1998

(30) Foreign Application Priority Data

Jul. 9, 1997 (DE) ..... 197 29 294

(51) Int. Cl.[7] ..... F41A 21/18
(52) U.S. Cl. ..... 42/78; 89/14.05; 102/524
(58) Field of Search ..... 42/78, 76.01; 89/14.05; 102/524

(56) References Cited

U.S. PATENT DOCUMENTS

| | | | | |
|---|---|---|---|---|
| 1,355,422 | * | 10/1920 | Pedersen | 42/78 |
| 2,498,052 | * | 2/1950 | Smith | 89/14.05 |
| 3,100,358 | * | 8/1963 | Robinson, Jr. | 42/78 |
| 4,924,614 | * | 5/1990 | Hoffman | 42/78 |
| 5,077,926 | * | 1/1992 | Krumm | 42/78 |
| 5,435,089 | * | 7/1995 | Rodney, Jr. | 42/51 |

FOREIGN PATENT DOCUMENTS

| | | |
|---|---|---|
| 3300175 A1 | 7/1984 | (DE) . |
| 40 01 130 A1 | 7/1991 | (DE) . |
| 42 00 171 A1 | 7/1993 | (DE) . |

OTHER PUBLICATIONS

"Waffentechnisches Taschenbuch", 1977, Rheinmetall, Düsseldorf, Germany, XP002139998, pp. 523–536.

"Handbook on Weaponry", 1982, Rheinmetall GmbH, Dësseldorf, Germany, pp. 571–586.

* cited by examiner

*Primary Examiner*—Stephen M. Johnson
(74) *Attorney, Agent, or Firm*—Venable; Norman N. Kunitz

(57) ABSTRACT

A rifled weapon tube (1), from which spin-stabilized projectiles (8) with driving bands (9) are fired. In order to reduce manifestations of wear on a driving band (9), it is known to stabilize a spin angle (δ) occurring during the firing or to cut deeper rifling grooves (3) into an inside wall (2) of the weapon tube (1). Both options can be realized only within limits as the compatibility between weapon tube (1) and projectile (8) must be ensured. The invention provides for another option of reducing the wear on the driving band (9). Increasing the number of rifling grooves (3) on the tube inside wall (2) reduces the frictional stress that occurs on the driving band (9). This new type of design for the rifling groove flanks (5), formed between a groove bottom (7) of rifling groove (3) and a lands (4) between the rifling grooves (3), reduces the total wear volume on the driving band (9). In this case, the rifling flanks (5) extend nearly perpendicular to the rifling groove bottom (7).

10 Claims, 2 Drawing Sheets

WEAPON TUBE

REFERENCE TO RELATED APPLICATIONS

This application claims the priority of German application Serial No. 197 29 294.1, filed Jul. 9, 1997, which is incorporated herein by reference.

BACKGROUND OF THE INVENTION

The invention relates to a weapon tube for firing spin-stabilized projectiles with driving bands, wherein the weapon tube has rifling in the form of grooves helically cut over the total periphery into a tube inside wall, so that a rifling groove flank forms on both sides toward a rifling groove bottom and thus encloses a respective rifling groove flank angle, and that lands exist between the rifling grooves so as to together determine a rifling profile for the tube. The projectiles for weapon tubes rifled in this way have one or sometimes even several driving bands (rotating bands), arranged one after another, for transmitting the spin, which driving bands are subjected to high stress during the firing acceleration inside the tube and are subjected to more or less high wear .

In order to raise the muzzle velocity and increase the range of an artillery weapon, the weapon tube is frequently lengthened, e.g. from 39 caliber lengths to 52 caliber lengths. As a result, the driving bands of the projectiles are stressed to their limits and wear out faster. The driving band wear can be reduced by reducing the surface pressure at the rifling groove flanks, whereby either the rifling angle (spin angle) is reduced or the number/depth of the rifling grooves or the driving band width are increased, or through a combination of these options. The surface pressure is caused by a rifling force R during the spin acceleration. Accordingly, the highest occurring rifling force must be used as a starting point for dimensioning the rifling grooves and driving bands.

The German published Patent Application No. DE-40 01 130 A1 describes a weapon tube with optimized rifling to improve the internal and external ballistics of the projectiles fired from this tube and to reduce driving band wear. The spin is optimized by taking into account a rifling force R(x), wherein the rifling angle is dissected into a Fourier series.

The German published Patent Application No. DE-42 00 171 A1 furthermore discloses a standardizing of the rifling force R(x) and teaches to use this to determine the rifling angle and also reduce the driving band wear. With the aid of this standardized rifling force and a predetermined final rifling angle, all relevant weapon tube parameters can already be specified during the production.

The rifling angle can be changed only slightly or not at all. Such a change jeopardizes the compatibility of some inserted projectiles. A change in the rifling depth, meaning the depth of a helical groove cut into the tube inside wall, jeopardizes the compatibility of all inserted projectiles. Changing the driving band width is not possible for inserted projectiles. To be sure, the use of more resistant materials for driving bands (e.g., soft iron instead of brass) leads to a reduction in the wear, but is highly problematic and rather involved, especially with inserted live projectiles (combat ammunition). In addition, it is to be expected that the service life of the weapon tube is negatively influenced.

It is the object of the invention to provide a weapon tube where the driving band wear at the projectile is reduced, without negatively influencing the projectile velocity in the muzzle region.

SUMMARY OF THE INVENTION

The above object is achieved according to the invention by a weapon tube for firing spin-stabilized projectiles with driving bands, which comprises: a weapon tube having rifling in the form of a plurality of helical grooves cut over the entire periphery into a tube inside wall, with the grooves being such that a respective rifling groove flank forms on both sides toward a rifling groove bottom and encloses a respective rifling groove flank angle $\alpha$, and such that lands exist between the respective rifling grooves, which grooves and lands together determine a rifling profile; and wherein the rifling grooves and lands are configured such that with an increased number of grooves, a total volume of the rifling grooves is equal to that for a smaller number of rifling grooves, and the rifling groove depth and spin angle ($\delta$) are the same for the increased number of rifling grooves as for the lower number of rifling grooves.

This solution is based on the realization that an increase in the number of rifling grooves will reduce the frictional stress (frictional work) per rifling flank on a projectile driving band inside the weapon tube. In order to avoid impressions on the projectile shell, caused by the increase in the number of rifling grooves, and thus the reduction of the land surfaces between the rifling grooves, the rifling profile according to the invention is designed such that the total rifling groove volume or the compressed driving band volume is equal to that resulting from a smaller number of rifling grooves. The rifling depth and the rifling angle are not changed as compared to the profile for a smaller number of rifling grooves. The internal and external ballistics for a higher number of rifling grooves is equal to that of a smaller number of rifling grooves. A large total lands area results if steep rifling flanks are created, which prevents the surface pressure between projectile shell and lands areas, and thus also the frictional work, from getting worse as compared to the rifling profile for a smaller number of rifling grooves.

Further advantageous features of the invention are disclosed.

The invention is explained in further detail and described in the following with the aid of a preferred embodiment of a 155 mm caliber artillery tube having a 52 caliber tube length.

DETAILED DESCRIPTION OF THE DRAWINGS

Figure 1:
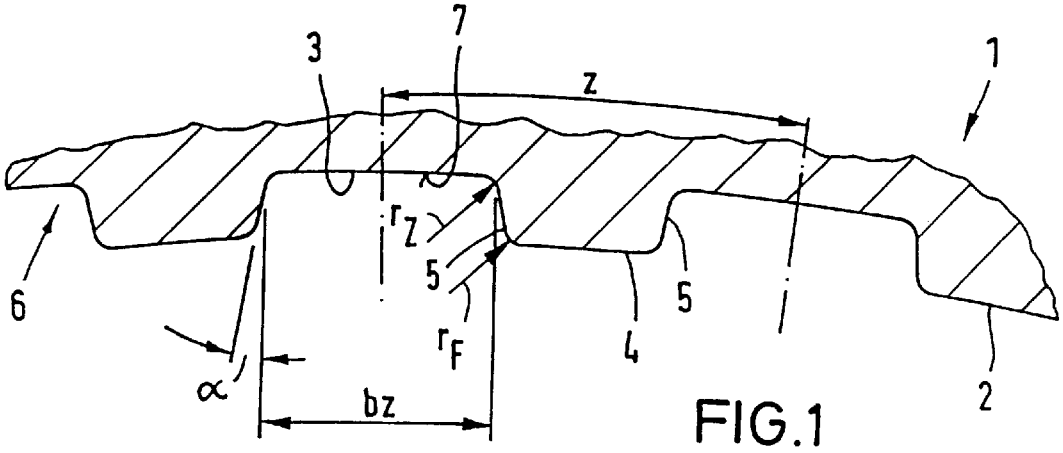
FIG. 1 is a cross sectional illustration of the tube rifling.
Figure 2:
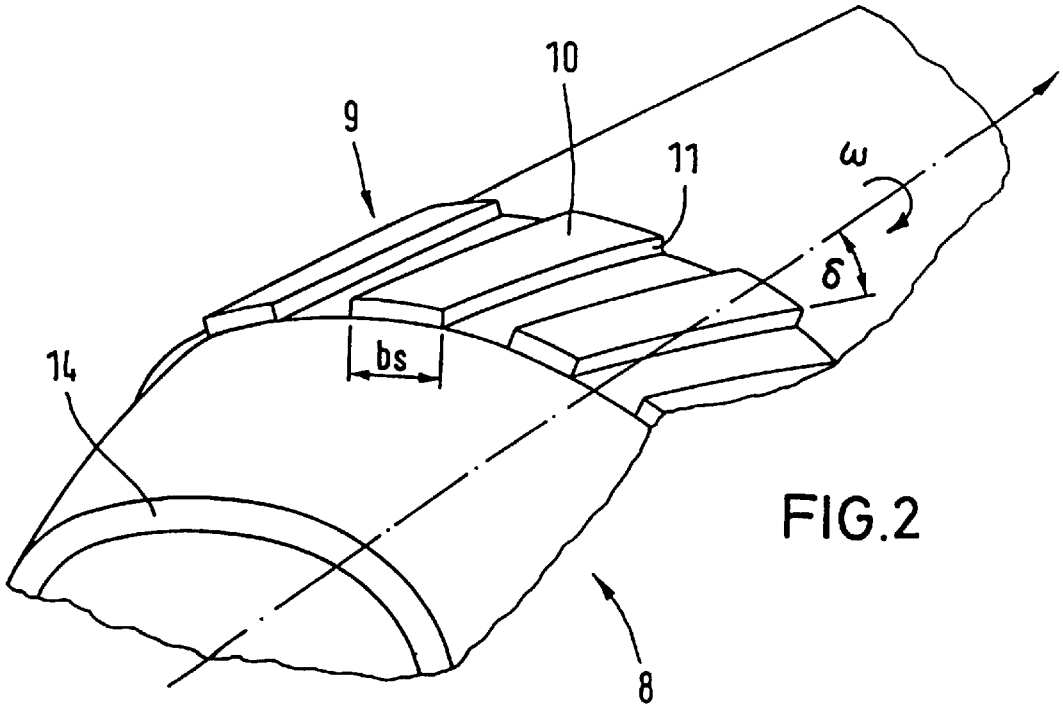
FIG. 2 is a perspective illustration of a portion or fragment of a driving band with associated projectile.
Figure 3A:
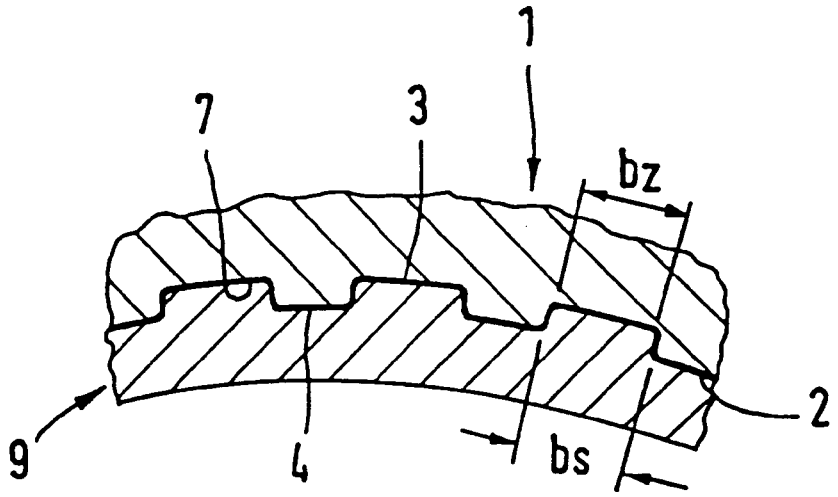
FIG. 3*a* is a cross-sectional view of the joint cooperation of a rifled weapon tube with a projectile driving band, without driving band wear at the start of the firing acceleration.
Figure 3B:
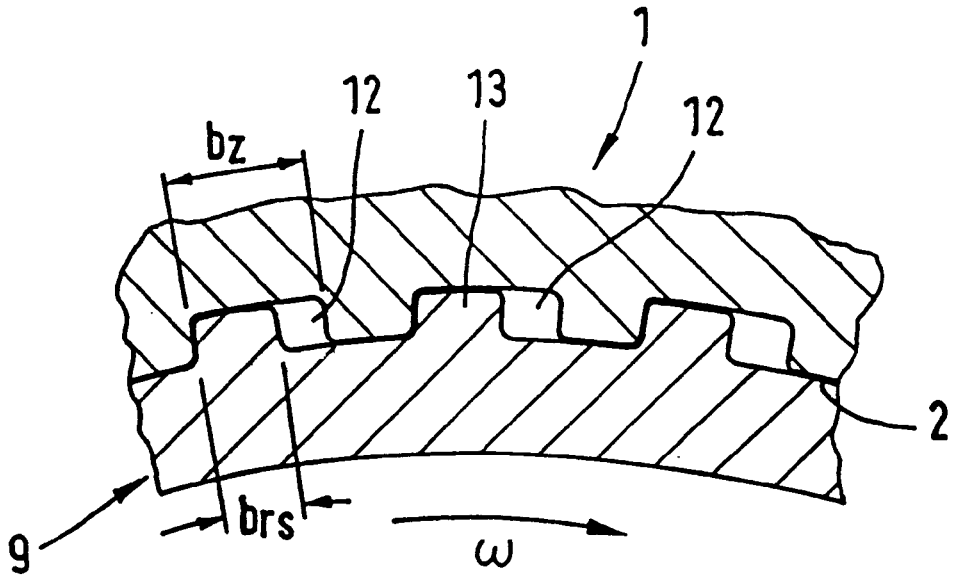
FIG. 3*b* is a cross-sectional view of the joint cooperation of a rifled weapon tube with the driving band of the projectile showing driving band wear.

FIG. 1 shows a cross-sectional detail of a weapon tube 1 with a plurality of rifling grooves 3, cut as helical grooves into the total periphery of a tube inside wall 2. The ridges 4 remaining between the rifling grooves 3 are also called lands 4. The rifling grooves 3 and lands 4 determine the structure of a rifling profile inside the weapon tube 1. The rifling grooves 3 have a groove width $b_Z$ and two groove flanks 5. A rifling groove depth 6 for rifling grooves 3 is determined by how deep the grooves are cut and represents a height difference between the lands 4 and a groove bottom 7 of rifling grooves 3. During the firing of a projectile 8, the lands 4 remaining between the rifling grooves 3 cut, in the standard way, helical grooves into a driving band 9 that is attached to the projectile 8 (FIG. 2). During the compression at firing, this driving band 9 is provided with a negative impression of the rifling profile of tube 1, wherein the depressions in the tube 1, the rifling grooves 3, appear as raised areas on the 5 driving band 9. These raised areas are called webs 10 and have a web width $b_S$ and two web flanks 11. At the start of the firing acceleration, the web width $b_S$ at the driving band 9 is equal to the rifling groove width $b_Z$ of the rifling groove 3 (FIG. 3*a*). While the projectile passes.through the tube 1, the web flanks 11 experience wear, meaning driving band wear, resulting in the formation of spaces or gaps 12. Once the projectile 8 leaves the tube 1, the driving band 9 will have residual webs 13, the width $b_{rs}$ of which can be considerably smaller than the rifling groove width $b_Z$ (FIG. 3*b*).

In order to increase the muzzle velocity of a projectile 8 without increasing the maximum gas pressure, the acceleration path of the projectile 8 can be extended and/or the propellant mass can be increased.

It is known that the total driving band wear is proportional to a frictional work at the driving band 9, which itself is proportional to the integral of the flank pressure, that is to say the surface pressure at the rifling flanks 5 over the acceleration path of projectile 8. The flank pressure is obtained additively from a share of gap 12, that developed as a result of the erosion through wear caused by the rotational acceleration of projectile 8 and the gas pressure. The larger the gap 12, the higher the gas pressure and thus the erosion through wear. At its maximum, the gas pressure can be equal to the gas pressure at the projectile base 14. Besides resulting in the formation of tangential forces, a large gap 12 also leads to the formation of radial forces, which negatively influence the projectile acceleration.

The total material erosion on the driving band 9 as a result of the rotating acceleration of projectile 8 during the projectile movement toward the muzzle of tube 1 is proportional to the square of the muzzle velocity.

Owing to an increase in the number of rifling grooves Z, the total wear volume is distributed over a larger area, which leads to a decrease in the number of gaps 12 that form. The gas pressure in gap 12 and the resulting additional driving band wear are reduced.

The sealing effect of the driving band 9 is furthermore increased through a reduction in the gap 12, which leads to reducing or avoiding the impressions caused by the rifling grooves and lands on the projectiles 8 and the connected wear on the land surfaces in the muzzle region of the weapon tube 1.

A muzzle speed of 827 m/s can be achieved with a tube 1 having a caliber length of 39. It is known that in this case 48 rifling grooves result in little driving band wear, so that the gap 12 is nearly equal to zero. At 52 caliber lengths, the muzzle speed is increased to 945 m/s. A strong driving band wear can now be observed for 48 rifling grooves. In order to keep the driving band wear caused by gas pressure in the gap 12 about the same for 827 m/s and for 945 m/s, the rifling groove number is increased from 48 to 60, so that the driving band wear for each rifling groove does not change as a result of the rotational acceleration of the projectile. The following must apply:

$$\frac{60}{48} \cong \left(\frac{945}{827}\right)^2$$

The deformation behavior of the driving band 9 when pressed into the rifling grooves 3 must be the same for 48 and 60 rifling grooves. That is why the same total rifling groove volume (number of rifling grooves Z .× rifling groove width $b_Z$× rifling groove depth 6)×rifling groove length is realized in the same way for 60 rifling grooves as for 48 rifling grooves. Since the rifling groove depth 6 for 48 grooves and for 60 grooves is the same, the rifling grooves width $b_Z$ for the rifling groove profile with 60 grooves is:

$$b_{z60} = \frac{48}{60} \cdot b_{z48}$$

The wear volume for each rifling groove 3 is equal to the flank surface of rifling groove flanks 5 times the vertical erosion standing on the rifling groove flank surface, which is proportional to the flank pressure.

In order to keep the gap 12 ideally small, the same volume of driving band 9 is now compressed according to the invention during the increase in the rifling groove number $Z_{60}$ to 60 rifling grooves as is squeezed for the smaller rifling groove number $Z_{48}$. For this, a steeper rifling groove flank angle α of approximately 90 is created between rifling groove flank 5 and the groove bottom 7, which avoids the occurrence of undesirable radial forces inside the weapon tube 1. The rifling groove depth 6 and the spin angle δ are not changed as compared to the weapon tube 1 with 48 rifling grooves.

At the lower groove bottom 7, the rifling groove profile itself preferably has an inside radius $r_Z$ of 0.5 mm relative to the respective groove flank 5 and the land 4 has an upper land radius $r_f$ relative to the rifling groove flank 5 of preferably 0.3 mm, thereby making it possible to avoid sharp-edged chamfers on the rifling surface, which would be carved into the driving band 9 during the compressing. The rifling flank surface can be varied by changing the rifling flank angle α between rifling flank 5 and the perpendicular line on the associated rifling groove bottom 7, so that as a result of the creation of steeper rifling flanks 5, i.e., smaller flank angles (α) the surface of the lands 4 is structurally enlarged, the rifling flank 5 surface is reduced, without causing a change in the surface pressure at these rifling groove flanks 5.

The reduction in the rifling groove flank angle from the known 30° to about 9° and, following a partial chrome-plating, to approximately 0° leads to a lower wear volume for each rifling groove. A flank pressure and thus the width of the crack 12 that results from the erosion perpendicular to the flank surface remain the same.

Several driving bands can be used in the known way in place of one driving band 9.

This new rifling flank design realizes the same compression and a total wear reduction of the driving band 9 for a 60 groove rifling profile as for a 48 groove rifling profile. In addition, a 20% reduction in the surface pressure caused by the rifling force R(x) is achieved.

The invention now being fully described, it will be apparent to one of the ordinary skill in the art that many changes and modifications can be made thereto without departing from the spirit or scope of the invention as set forth herein.

What is claimed:

1. A weapon tube for firing spin-stabilized projectiles with driving bands, comprising: a weapon tube having rifling in the form of a plurality of helical grooves cut over the entire periphery into a tube inside wall, with the grooves being such that a respective rifling groove flank forms on both sides toward a rifling groove bottom and encloses a respective rifling groove flank angle $\alpha$, and such that lands exist between the respective rifling grooves, which grooves and lands together a rifling profile; and wherein: the tube has an increased number of rifling grooves relative to a smaller number of such grooves in a shorter weapon tube; the rifling grooves and lands are configured such that with the increased number of grooves, a total volume of the rifling grooves is equal to that for the small number of rifling grooves, and the rifling groove depth and spin angle ($\delta$) are the same for the increased number of rifling grooves as for the smaller number of rifling grooves.

2. A weapon tube according to claim 1, wherein each rifling flank is nearly perpendicular to the rifling groove bottom to reduce the total wear on the driving band when the number of rifling grooves is increased.

3. A weapon tube according to claim 2, wherein the rifling flank angle ($\alpha$) is smaller than 9.5° for a weapon tube that is not chrome-plated.

4. A weapon tube according to claim 2, wherein the rifling flank angle ($\alpha$) is approximately 0° for a partially or fully chrome-plated weapon tube.

5. A weapon tube according to claim 2, wherein an inside radius ($r_Z$) of less than 0.5 mm exists between the rifling groove bottom and each associated rifling groove flank; and a lands radius ($r_F$) of less than 0.3 mm exists between each land and the upper section of each associated respective rifling flank.

6. A method of forming an improved weapon tube for firing spin-stabilized projectiles with driving bands, with the weapon tube having rifling in the form of a given number of helical grooves cut over the entire periphery into a tube inside wall such that a respective rifling groove flank forms on both sides toward a rifling groove bottom and encloses a respective rifling groove flank angle, and such that lands exist between the respective rifling grooves, which together with the lands determine a rifling profile, and with the rifling grooves having a given groove depth and spin angle; said method comprising forming the given number of rifling grooves and lands in the tube inside surface with an increased number of grooves relative to a smaller given number of such grooves in a shorter weapon tube while maintaining the total volume of the rifling grooves equal to that for the smaller given number of rifling grooves, and while maintaining the rifling groove depth and the spin angle ($\delta$) equal to those for the smaller given number of rifling grooves.

7. The method according to claim 6, further comprising forming the respective rifling flanks to be nearly perpendicular to the rifling groove bottom to reduce the total wear on the driving band when the number of rifling grooves is increased.

8. The method according to claim 7, including forming each respective rifling flank angle ($\alpha$) to be smaller than 9.5° for a weapon tube that is not chrome-plated.

9. The method according to claim 7, including forming each respective rifling flank angle ($\alpha$) to be approximately 0° for a partially or fully chrome-plated weapon tube.

10. The method according to claim 7 including forming each rifling groove flank to have an inside radius ($r_Z$) of less than 0.5 mm between the rifling groove bottom and the respective rifling groove flank, and a lands radius ($r_f$) of less than 0.3 mm between each land and the upper section of each associated respective rifling flank.

* * * * *